US008291668B2

(12) United States Patent
Iske et al.

(10) Patent No.: US 8,291,668 B2
(45) **Date of Patent: *Oct. 23, 2012**

(54) DEVICE FOR IN-SITU BARRIER

(75) Inventors: Brian J. Iske, Nashua, NH (US); Jyoti Seth, Andover, MA (US); Xia Cao, Arlington, MA (US); Sonya M. Santos, Jamaica Plain, MA (US); Enzo J. Orellana, Somerville, MA (US)

(73) Assignee: W. R. Grace & Co.-Conn., Columbia, MD (US)

( * ) Notice: Subject to any disclaimer, the term of this patent is extended or adjusted under 35 U.S.C. 154(b) by 133 days.

This patent is subject to a terminal disclaimer.

(21) Appl. No.: 12/477,265

(22) Filed: Jun. 3, 2009

(65) Prior Publication Data

US 2009/0282762 A1 Nov. 19, 2009

Related U.S. Application Data

(60) Division of application No. 11/468,544, filed on Aug. 30, 2006, now Pat. No. 7,565,779, which is a continuation-in-part of application No. 11/066,927, filed on Feb. 25, 2005, now Pat. No. 7,584,581.

(51) Int. Cl.

| | |
|---|---|
| ***E02D 37/00*** | (2006.01) |
| ***E04G 23/00*** | (2006.01) |
| ***E04B 1/18*** | (2006.01) |

(52) U.S. Cl. ..... 52/514.5; 52/414

(58) Field of Classification Search ..... 52/169.14, 52/404.1, 414, 514, 514.5, 169.5, 562; 405/222, 405/233

See application file for complete search history.

(56) References Cited

U.S. PATENT DOCUMENTS 741,589 A 10/1903 McBean
2,263,070 A 11/1941 Cusick
(Continued)

FOREIGN PATENT DOCUMENTS

DE 2324097 A1 2/1974
(Continued)

OTHER PUBLICATIONS

"Achieving Dry Stations and Tunnels with Flexible Waterproofing Membranes" Egger et al. Mar. 3, 2004.*

(Continued)

*Primary Examiner* — Joshua J Michener
*Assistant Examiner* — Andrew Triggs
(74) *Attorney, Agent, or Firm* — Stephan P. Williams; Craig K. Leon

(57) ABSTRACT

The present invention relates to a multi-layer fluid delivery device for post-installation in-situ barrier creation. The device provides a medium for post-installation injection of remedial substances such as waterproofing polymeric resins or cementitious materials, insecticides, mold preventatives, rust retardants and the like. The device comprises a first layer and a second layer, with optionally an intermediate layer therebetween, and a plurality of tubes extending outwardly from the first layer. The first layer is preferably semi-permeable; the second layer is non-permeable; the optional intermediate layer is a void-inducing layer. The multi-layered device is attached to a structural substrate and a construction material such as concrete or shotcrete is applied against its surface (and around the plurality of tubes). Thereafter, a free flowing active substance can be injected through the tubes to fill the air space in the multi-layered device.

16 Claims, 8 Drawing Sheets

U.S. PATENT DOCUMENTS

| | | | | | |
|---|---|---|---|---|---|
| 2,357,769 | A | | 9/1944 | Rushmer | |
| 3,099,911 | A | | 8/1963 | Turzillo | |
| 3,137,601 | A | | 6/1964 | Menzer | |
| RE25,614 | E | | 7/1964 | Turzillo | |
| 3,780,975 | A | | 12/1973 | Turzillo | |
| 3,844,527 | A | | 10/1974 | Scott | |
| 3,888,087 | A | * | 6/1975 | Bergsland | 405/36 |
| 3,969,852 | A | | 7/1976 | Krings | |
| 3,973,408 | A | | 8/1976 | Paverman | |
| 3,984,989 | A | | 10/1976 | Turzillo | |
| 4,110,151 | A | | 8/1978 | Morse | |
| 4,134,242 | A | | 1/1979 | Musz et al. | |
| 4,177,618 | A | | 12/1979 | Felter | |
| 4,259,028 | A | | 3/1981 | Cook | |
| 4,370,078 | A | | 1/1983 | Gadelle et al. | |
| 4,386,876 | A | | 6/1983 | Dupeuble | |
| 4,391,555 | A | | 7/1983 | Bruger et al. | |
| 4,391,556 | A | | 7/1983 | Bruger et al. | |
| 4,543,016 | A | | 9/1985 | Tallard | |
| 4,563,852 | A | | 1/1986 | Achtenberg et al. | |
| 4,574,541 | A | * | 3/1986 | Raidt et al. | 52/169.5 |
| 4,623,283 | A | | 11/1986 | Chew | |
| 4,712,347 | A | | 12/1987 | Sperber | |
| 4,730,805 | A | | 3/1988 | Yokota et al. | |
| 4,730,953 | A | * | 3/1988 | Tarko | 405/45 |
| 4,733,989 | A | * | 3/1988 | Harriett | 405/43 |
| 4,754,590 | A | | 7/1988 | Gordon | |
| 4,787,597 | A | | 11/1988 | Yokota et al. | |
| 4,840,515 | A | * | 6/1989 | Freese | 405/45 |
| 4,905,441 | A | | 3/1990 | Landers | |
| 4,927,297 | A | | 5/1990 | Simpson | |
| 4,943,185 | A | * | 7/1990 | McGuckin et al. | 405/45 |
| 4,956,951 | A | * | 9/1990 | Kannankeril | 52/169.5 |
| 5,044,821 | A | * | 9/1991 | Johnsen | 405/50 |
| 5,201,612 | A | | 4/1993 | Gadelle et al. | |
| 5,245,812 | A | | 9/1993 | Landers | |
| 5,263,795 | A | | 11/1993 | Corey et al. | |
| 5,287,674 | A | | 2/1994 | Sperber | |
| 5,365,716 | A | | 11/1994 | Munson | |
| 5,383,314 | A | * | 1/1995 | Rothberg | 52/169.5 |
| 5,385,504 | A | | 1/1995 | Hussey et al. | |
| 5,450,700 | A | | 9/1995 | Hackman | |
| 5,632,571 | A | * | 5/1997 | Mattox | 405/19 |
| 5,688,073 | A | * | 11/1997 | Brodeur et al. | 405/45 |
| 5,692,348 | A | * | 12/1997 | Ambrosino | 52/169.5 |
| 5,725,327 | A | | 3/1998 | Hussey et al. | |
| 5,792,552 | A | | 8/1998 | Langkamp et al. | |
| 5,794,388 | A | * | 8/1998 | Jackman | 52/169.5 |
| 5,819,496 | A | | 10/1998 | Sperber | |
| 5,842,519 | A | | 12/1998 | Sydansk | |
| 5,891,549 | A | | 4/1999 | Beretta et al. | |
| 5,911,539 | A | | 6/1999 | Egan et al. | |
| 6,048,131 | A | * | 4/2000 | Laak | 405/43 |
| 6,164,868 | A | * | 12/2000 | Goughnour | 405/43 |
| 6,202,370 | B1 | | 3/2001 | Miller et al. | |
| 6,290,021 | B1 | | 9/2001 | Strandgaard | |
| 6,336,773 | B1 | * | 1/2002 | Anderson et al. | 405/262 |
| 6,565,289 | B2 | * | 5/2003 | Khamis | 405/286 |
| 6,588,986 | B1 | | 7/2003 | Sibilla | |
| 6,655,107 | B2 | | 12/2003 | Dean | |
| 6,662,516 | B2 | * | 12/2003 | Vandehey et al. | 52/407.1 |
| 6,672,016 | B2 | * | 1/2004 | Janesky | 52/169.5 |
| 6,684,579 | B2 | * | 2/2004 | Brunson et al. | 52/169.5 |
| 6,691,472 | B2 | * | 2/2004 | Hubert | 52/169.5 |
| 6,892,395 | B2 | * | 5/2005 | Schweer | 2/94 |
| 6,976,804 | B1 | | 12/2005 | Asplin | |
| 7,014,390 | B1 | * | 3/2006 | Morris | 405/50 |
| 7,032,660 | B2 | | 4/2006 | Vinegar et al. | |
| 7,048,469 | B1 | * | 5/2006 | Jansson | 405/20 |
| 7,077,198 | B2 | | 7/2006 | Vinegar et al. | |
| 7,386,957 | B2 | * | 6/2008 | Duffney | 52/169.5 |
| 7,565,779 | B2 | * | 7/2009 | Iske et al. | 52/742.13 |
| 7,584,581 | B2 | * | 9/2009 | Iske | 52/380 |
| 2002/0139068 | A1 | * | 10/2002 | Janesky | 52/169.5 |
| 2002/0157344 | A1 | | 10/2002 | Dean | |
| 2003/0126810 | A1 | * | 7/2003 | Brunson et al. | 52/169.5 |
| 2003/0161691 | A1 | | 8/2003 | Marshall | |
| 2003/0200708 | A1 | * | 10/2003 | Parker | 52/169.5 |
| 2004/0168802 | A1 | | 9/2004 | Creel et al. | |
| 2004/0200173 | A1 | | 10/2004 | Drake | |
| 2006/0010826 | A1 | | 1/2006 | Canteri | |
| 2009/0126291 | A1 | * | 5/2009 | Iske | 52/173.1 |
| 2009/0274518 | A1 | * | 11/2009 | Iske | 405/43 |
| 2009/0282762 | A1 | * | 11/2009 | Iske et al. | 52/302.1 |

FOREIGN PATENT DOCUMENTS

| | | | |
|---|---|---|---|
| DE | 2841452 | A1 | 3/1980 |
| EP | 1267035 | A1 | 12/2002 |
| WO | 2005040555 | A1 | 5/2005 |

OTHER PUBLICATIONS

Translation of office action in RU 2007135350 (national phase of PCT/US06/06693, claiming priority to parent U.S. Appl. No. 11/066,927, filed Jan. 29, 2009, 22 pages, Russian Patent Office.

Egger et al., "Achieving Dry Stations and Tunnels with Flexible Waterproofing Membranes", Mar. 2, 2004 (found at http://dr-saucer.com/technical_info/waterproofing).

Nilsson, Lars, International Search Report & Written Opinion PCT/US06/34079, Jul. 17, 2007, European Patent Office as International Search Authority, 10 pages, Rijswijk, The Netherlands.

Seidel, Marianne, International Preliminary Report on Patentability—PCT/US06/06693, Jul. 25, 2008, 11 pages, United States Patent and Trademark Office as International Searching Authority, Alexandria, Virginia, USA.

Various web site information on drainage mats (including SuperDrain, Enkadrain, Terradrain, Senergy, Tenax, Ultradrain, AmerDrain, J-Drain, Fondavis, Ruble, Terram & Mirafi drainage mats), 20061.

Young, Lee W., International Search Report & Written Opinion PCT/US06/06693, Nov. 6, 2007, United States Patent and Trademark Office as International Search Authority, 9 pages, Alexandria, Virginia, USA.

* cited by examiner

DEVICE FOR IN-SITU BARRIER

CROSS-REFERENCE TO RELATED APPLICATIONS

This application is a division of application U.S. Ser. No. 11/468,544 filed on Aug. 30, 2006 now U.S. Pat. No. 7,565,779, which is a continuation-in-part of application U.S. Ser. No. 11/066,927 filed on Feb. 25, 2005 now U.S. Pat. No. 7,584,581, from which priority is claimed and the disclosure of which is incorporated herein by reference.

FIELD OF THE INVENTION

The present invention relates to a device for post-installation in-situ barrier creation, and more particularly to a multi-layered device providing a medium for post-installation injection of remedial substances such as waterproofing resins or cements, insecticides, mold preventatives, rust retardants and the like.

BACKGROUND OF THE INVENTION

It is common in underground structures, such as tunnels, mines and large buildings with subterranean foundations, to require that the structures be watertight. Thus, it is essential to prevent groundwater from contacting the porous portions of structures or joints, which are typically of concrete. It is also essential to remove water present in the voids of such concrete as such water may swell during low temperatures and fracture the concrete or may contact ferrous portions of the structure, resulting in oxidation and material degradation. Therefore, devices have been developed for removing water from the concrete structure and for preventing water from contacting the concrete structure.

Attempts at removing groundwater from the concrete structure have included a permeable liner and an absorbent sheet. Both absorb adjacent water, carrying it from the concrete structure. This type is system is limited, however, because it cannot introduce a fluid or gaseous substance to the concrete and as the water removed is only that in contact with the system. Additionally, this system does not provide a waterproof barrier.

Among attempts at preventing water from contacting the concrete structure has been the installation of a waterproof liner between a shoring system and the concrete form. This method fails if the waterproof liner is punctured with rebar or other sharp objects, which is common at construction sites. In such an occurrence, it may be necessary for the concrete form to be disassembled so a new waterproof liner may be installed. Such deconstruction is time consuming and expensive. It would therefore be preferable to install a system that provides a secondary waterproof alternative, should the initial waterproof layer fail. Additionally, attempts at preventing water from contacting a concrete structure have included installation of a membrane that swells upon contact with water. While this type of membrane is effective in absorbing the water and expanding to form a water barrier, this type of membrane is limited in its swelling capacity. Therefore, it would be preferable to provide a system that is unlimited in its swelling capacity by allowing a material to be added until the leak is repaired.

Another attempt to resolving this problem was disclosed in "Achieving Dry Stations and Tunnels with Flexible Waterproofing Membranes," published by Egger, et al. on Mar. 2, 2004, which discloses a flexible membrane for waterproofing tunnels and underground structures. The flexible membrane includes first and second layers, which are installed separately. The first layer is a nonwoven polypropylene geotextile, which serves as a cushion against the pressure applied during the placement of the final lining where the membrane is pushed hard against the sub-strata. The first layer also transports water to the pipes at the membrane toe in an open system. The second layer is commonly a polyvinyl chloride (PVC) membrane or a modified polyethylene (PE) membrane, and is installed on top of the first layer. The waterproof membrane is subdivided into sections by welding water barriers to the membrane at their base. Leakage is detected through pipes running from the waterproof membrane to the face of the concrete lining. The pipes are placed at high and low points of each subdivided section. If leakage is detected, a low viscosity grout can be injected through the lower laying pipes. However the welding and the separate installation of the first and second layers make this waterproof system difficult to install, thus requiring highly skilled laborers.

It would therefore be advantageous to provide an in-situ multi-layered device for post-installation concrete sealing, and more particularly a providing a medium for post-installation injection of waterproofing resin.

SUMMARY OF THE INVENTION

The present invention relates to a device for post-installation in-situ barrier creation.

One object of the invention is to provide a single application, which includes a first layer providing an initial waterproof surface. Another object of the invention is to provide a secondary, remedial layer that is operable should the first layer fail. A further object of the invention is to provide that such multi-layer system be quickly and easily installed. An additional object of the present invention allows selective introduction of a fluid substance to specific areas of a structure.

Accordingly, it is an object of the present invention to provide a multi-layered device that includes a waterproof layer providing a first level of protection from water penetration, that includes a second, remedial protection from water penetration through delivering a fluid substance to a structure, that allows the introduction of a fluid substance in situ, that allows selective introduction of a fluid substance to specific areas of a structure, that is affixable to a variety of surfaces, and that is easily and quickly installable. Other features and advantages of the invention will be apparent from the following description, the accompanying drawings and the appended claims.

One embodiment of the invention embraces a multi-layer fluid delivery device for introducing a free-flowing active substance to a structure in situ. The device includes a first layer and a second layer. The first layer has an inwardly facing surface and an outwardly facing surface and is permeable to the active substance, but at least nearly impermeable to a structural construction material (such as concrete or shotcrete) that will be applied against the outwardly facing surface of the first layer. The second layer is water impermeable and has an inwardly facing first side and an outwardly facing second side. The inwardly facing first side of the second layer is affixed, either directly or indirectly, to the inwardly facing surface of the first layer such that all or a substantial portion of the second layer is spaced apart from the first layer to create air space between the first and second layers. The device further includes a plurality of tubes affixed to and extending outwardly from the first layer, the tubes being adapted to permit inflow of the active substance into the air space.

In a preferred embodiment of the above-described device, the second layer of the device is substantially planar and the device additionally includes an intermediate layer between the first layer and the second layer. The intermediate layer separates the first and second layers and includes a plurality of interconnected interstitial air spaces sufficient to permit inflow of the active substance between the first layer and the second layer.

Another embodiment of the invention embraces a method of providing a free-flowing active substance to a structure in situ. The method comprises providing a multi-layer fluid delivery device, such as is described above; attaching the device to a structural substrate so that the outwardly facing second side of the second layer faces the substrate; affixing a plurality of tubes to the first layer so that they extend outwardly therefrom, the tubes being adapted to permit inflow of the active substance into the air space in the device; placing a concrete form or framework adjacent the outwardly facing surface of the first layer so that the plurality of tubes are affixed to and extend through the form or framework; applying a construction material, such as concrete or shotcrete, to the form or framework such that it contacts the outwardly facing surface of the first layer and allowing it to harden; and injecting the free-flowing active substance through one or more of the plurality of tubes to partially or completely fill the air space in the device with the active substance.

DETAILED DESCRIPTION OF THE INVENTION

Several embodiments of the present invention may be more readily understood by reference to the accompanying Figures, which are described in more detail below. Of course, these Figures represent preferred embodiments and are for illustrative purposes only. It is intended that the invention should not be limited solely to these embodiments, but rather should encompass the full scope of the appended claims, including any equivalents thereto.

Figure 1:
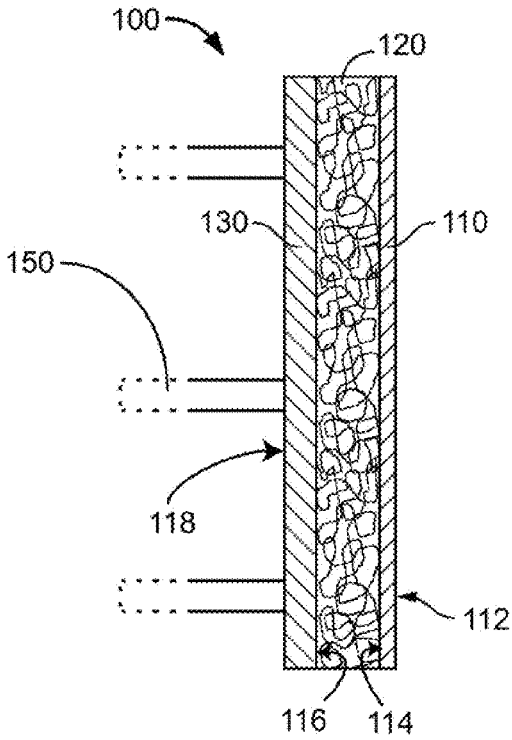
FIG. 1 is a cross sectional side view of one embodiment of a multi-layer fluid delivery device of the present invention.

FIG. 1 depicts, in general, an embodiment of the multilayer fluid delivery device 100. Substance delivery device 100 is a multi-layer device for delivering active substances to a structure, in situ, wherein the multi-layer device has at least two layers. In a preferred embodiment, substance delivery device 100 consists of three conjoined layers: first layer 130, intermediate layer 120, and second layer 110. While a preferred embodiment of the invention consists of three layers joined together, alternate multiple-layer configurations are possible. In addition, the device includes at least one tube 150 affixed to and extending outwardly from the first layer, wherein the tube is adapted to permit inflow of active substance into the device as desired. The tube may be any desired length (and, thus, is depicted, in part, in dashed or phantom lines). For example, the tube may be simply a short nipple to which a further extended tube is attached prior to use. Ultimately, the tube (or nipple plus extension tube) should preferably have a length that is sufficient to extend beyond the thickness of the structural construction material to be applied against the device in use.

First layer 130 is preferably semi-permeable, that is it should be made of a material that is permeable to active substances (i.e., fluids or gases) that are desired to be injected therethrough, while substantially prohibiting passage of concrete or other similar structural construction materials. A polypropylene or polyethylene non-woven geotextile is suitable, although woven or perforated or microporous fabrics may also be utilized. Additionally, other materials known in the art (e.g., polyester, nylon, etc.) may be preferable depending on the particular application. First layer 130 has an inwardly facing surface 116 and an outwardly facing surface 118.

Second layer 110 is a non-permeable layer that is preferably, but not necessarily, waterproof and/or self-sealing. Second layer 110 can be an asphalt sheet, or other like material, such as a polymer resin (e.g. polyethylene, polypropylene, polystyrene, nylon, polyvinylchloride, etc.), known in the art. Second layer 110 has an outwardly facing second side 112 and an inwardly facing first side 114. The inwardly facing first side 114 of second layer 110 may be affixed directly or indirectly (e.g., through intermediate layer 120) to the inwardly facing surface of the first layer. However, all or a substantial portion of the second layer must be spaced apart from the first layer to create air space therebetween. This separation between the first and second layers may be achieved either by inclusion of an intermediate layer 120, as described below, or by utilizing a second layer with various types of profiles, as described below.

Second layer 110 may optionally have an adhesive affixed to its outwardly facing second side 112, to its inwardly facing first side 114, or to both sides 112 and 114. Adhesive on the inwardly facing first side 114 aids in joining adjacent panels of the device and/or in adhering the second layer to the first layer or the optional intermediate layer (described below). Adhesive on the outwardly facing second side 112 aids in affixing the device to a structural substrate 20 (e.g., a shoring system, as seen in FIGS. 4 and 5).

Intermediate layer 120 is a void-inducing layer, preferably having a plurality of interconnected interstitial spaces, conducive to permitting a free-flowing active substance to flow throughout substance delivery device 100 and fill all or part of the air space between the first and second layers. Intermediate layer 120 may be formed by an open lattice of fibers, fused filaments, or other profiles (as described below) of sufficient rigidity to maintain the presence of the void when an external force is exerted against substance delivery device 100, such as, for example, when a structural construction material (e.g., concrete or shotcrete) is applied against it. A polypropylene lattice or other similarly rigid material (e.g. polystyrene, polyethylene, nylon, etc.) is preferable. The presence of intermediate layer 120 permits the channeling of free-flowing substances through substance delivery device 100. Intermediate layer 120 either channels water away from structural construction material 200, or provides a medium for transporting a free-flowing active substance adjacent to an inner surface of structural construction material 200 (see FIGS. 4 and 5).

Figure 2:
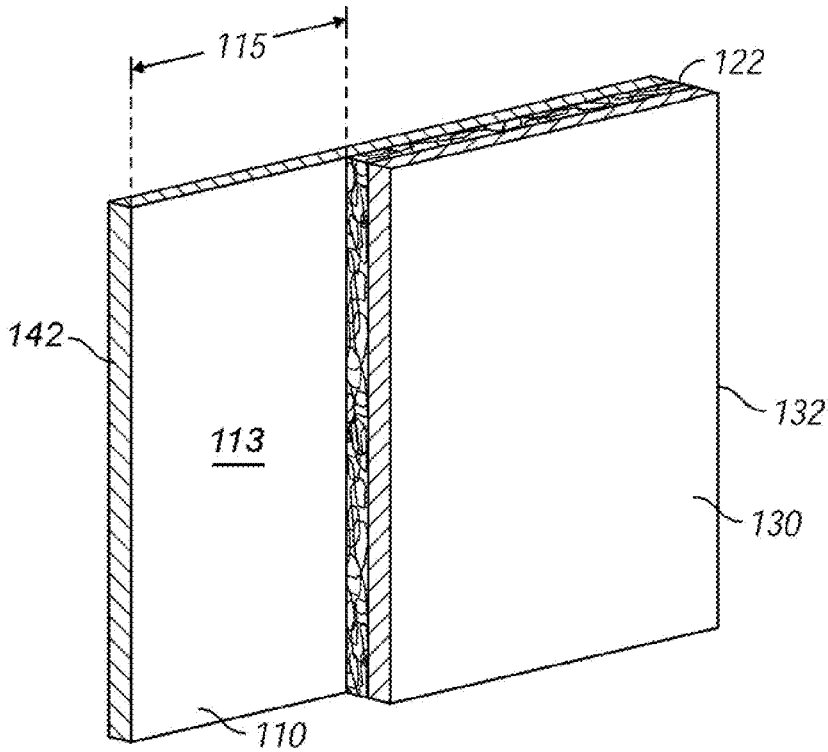
FIG. 2 is perspective view of the device shown in FIG. 1 with an interlinking extension portion (tubes 150 not shown for simplification).

Referring to FIG. 2, second layer 110, intermediate layer 120, and first layer 130 are fixedly attached, with intermediate layer 120 interposed between second layer 110 and first layer 130. Second layer 110, intermediate layer 120, and first layer 130 are each defined by a plurality of sides, respectively forming second layer perimeter 142, intermediate layer perimeter 122, and first layer perimeter 132. In the preferred embodiment, intermediate layer perimeter 122 and first layer perimeter 132 are dimensionally proportional, such that permeable layer perimeter 122 and semi-permeable layer perimeter 132 are equivalently sized. Intermediate layer 120 and first layer 130 have a first width that extends horizontally across the layers. Second layer perimeter 142 is partially proportional to intermediate layer perimeter 122 and first layer perimeter 132, such that at least two sides of second layer perimeter 142 are equivalently sized to the corresponding sides of intermediate layer perimeter 122 and first layer perimeter 132. Second layer 110 has a second width that extends horizontally across second layer 110. The second width of second layer 110 is greater than the first width of intermediate layer 120 and first layer 130. Thus, referring to FIGS. 2 and 3, when the bottom, top and right side edges of first layer 130, intermediate layer 120, and second layer 110 are aligned, the second layer will include an extension portion 113 that extends an extension distance 115 from an edge of first layer 130 and intermediate layer 120. The second layer extension portion 113 provides an underlay for overlapping a subsequently installed substance delivery device 100 thereupon, thereby eliminating potential weakness at the splice where panels of substance delivery device 100 abut.

Figure 4:
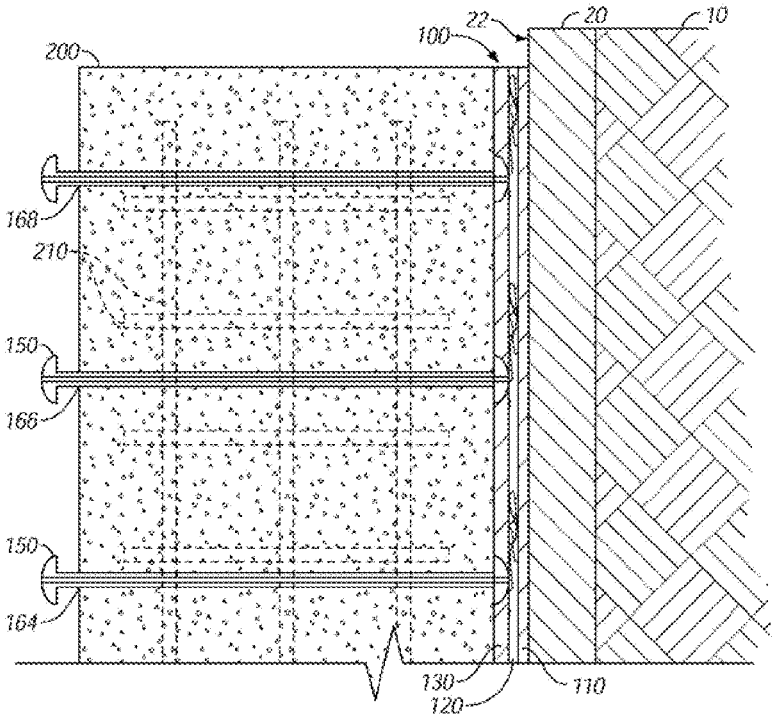
FIG. 4 is a cross-sectional side view of the device installed between a rebar matrix and structural substrate.
Figure 5:
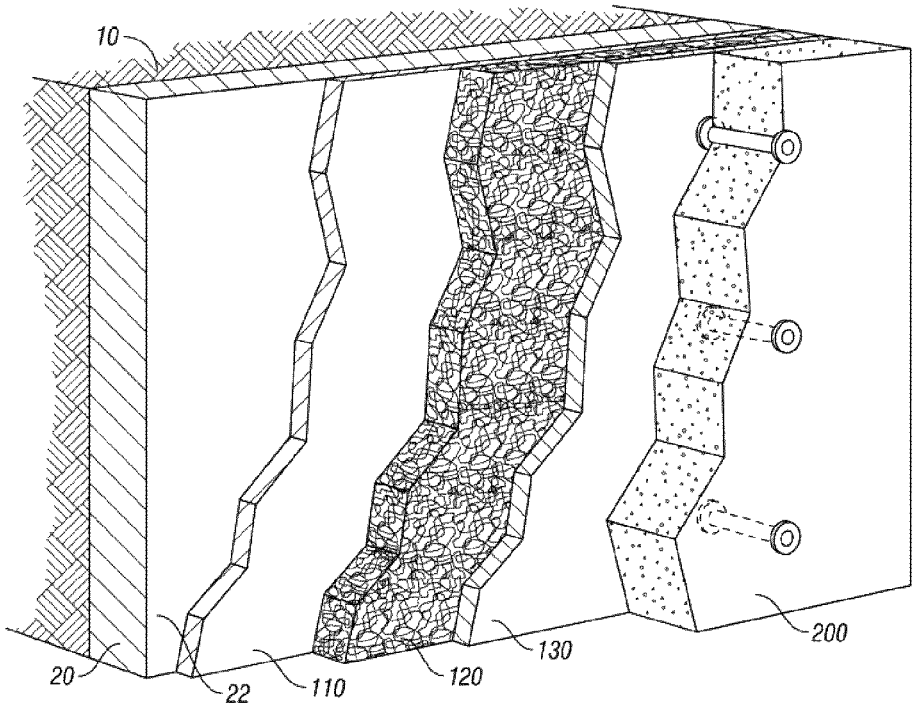
FIG. 5 is a perspective view of the device installed between a concrete structure and a structural substrate.

In a preferred embodiment, seen in FIGS. 4 and 5, a structural substrate 20 (e.g., a shoring system) is installed to retain earth 10 when a large quantity of soil is excavated. Structural substrate 20 includes common shoring techniques such as I-beams with pilings, shotcrete, etc. The multi-layer fluid delivery device 100 is fixedly attached to the structural substrate exterior surface 22 so that the outwardly facing second side 112 of said second layer 110 faces said substrate. As previously discussed, the device 100 can be attached to structural substrate exterior surface 22 by applying an adhesive to second layer second side 112 and affixing it to the structural substrate exterior surface 22. Alternatively, the device 100 can be attached to the structural substrate via any suitable attachment means such as, for example, with nails, screws, etc. In a preferred embodiment second layer 110 is self-sealing. Thus, puncturing second layer 110 with a plurality of nails will negligibly affect the second layer's ability to provide a waterproof barrier.

Figure 3:
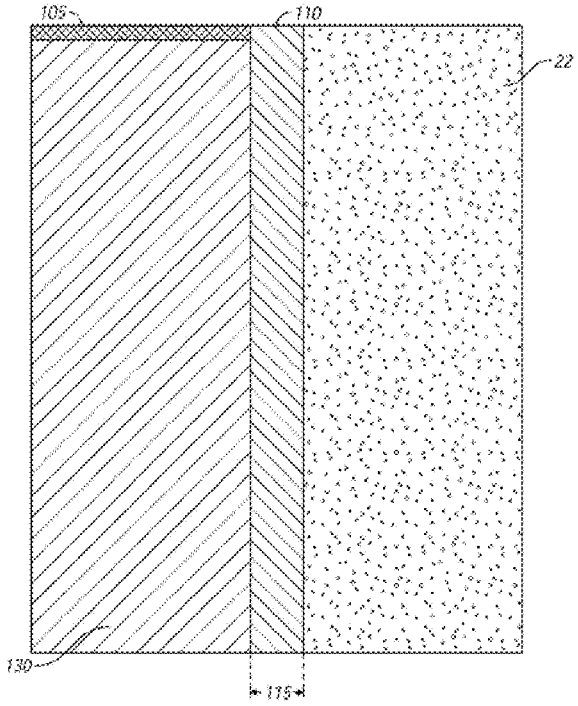
FIG. 3 is a front view of the device installed onto a structural substrate (e.g., a shoring system) (tubes 150 not shown for simplification).
Figure 6:
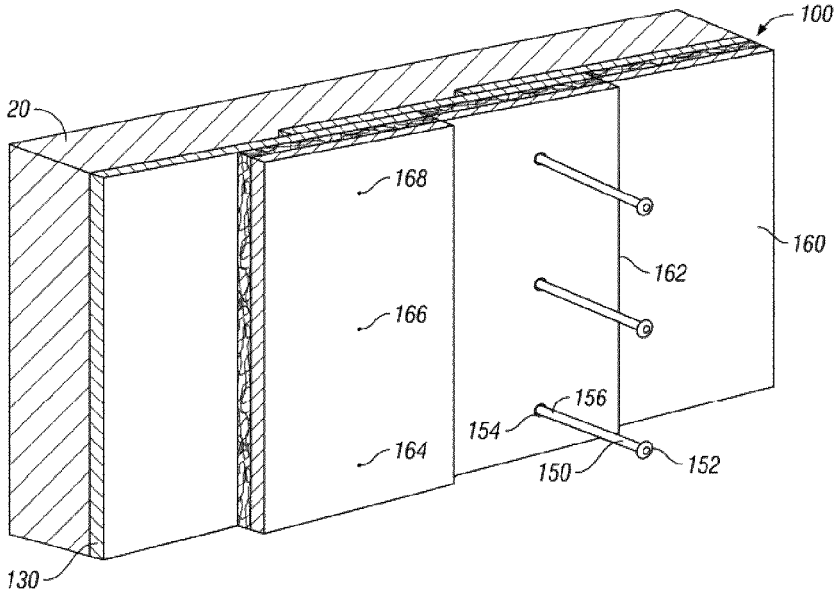
FIG. 6 is a perspective view of compartmentalized fluid delivery system with fluid injecting tubes attached.

Referring to FIGS. 3 and 6, substance delivery device 100 canvases structural substrate exterior surface 22. Substance delivery device 100 can be cut to any size, depending on the application. If a single substance delivery device 100 does not cover the desired area, a plurality of panels of substance delivery device 100 are used in concert to provide waterproof protection. As previously discussed, substance delivery device 100 may include second layer extension portion 113 for reinforcement at the abutment between adjacent panels of substance delivery device 100. Thus, a first panel of substance delivery device 100 is fixedly attached to structural substrate exterior surface 22, with second layer extension portion 113 extending outwardly onto structural substrate exterior surface 22. A second panel of substance delivery device 100 overlays second layer extension portion 113 of the first panel of substance delivery device 100, thereby interlinking the first and second panels of substance delivery device 100. This process is repeated until the plurality of panels of substance delivery device 100 blanket structural substrate exterior surface 22. The area of overlap between to adjacent panels of substance delivery device 100 preferably extends vertically. The upper terminal end of substance delivery device 100, proximate the upper edge of the constructed form (not shown), is sealed with sealing mechanism 105. Sealing mechanism 105 prevents the injected fluid from being discharged through the top of substance delivery device 100. Sealing mechanism 105 may be a clamp or other similar clenching device for sealing the upper terminal end of substance delivery device 100.

Referring to FIG. 6, division strip 162 is fixedly attached in a vertical orientation between the junction points of adjacent substance delivery devices 100. In the preferred embodiment division strip 162 has an adhesive surface, thereby allowing division strip 162 to be quickly and safely installed. Alternatively, division strip 162 may be installed by driving a plurality of nails, or similar attaching means, through division strip 162. Second layer extension portion 113 may be of such width as to accommodate division strip 162 and still permit joining to an adjacent panel of substance delivery device 100.

Division strip 162 is preferably comprised of a material that swells upon contact with water. When water interacts with division strip 162, division strip 162 outwardly expands, thereby eliminating communication between the abutting substance delivery devices 100. Thus, division strip 162 compartmentalizes each panel of substance delivery device 100. Compartmentalization enables selective injection of a active substance (fluid or gas) into a predetermined panel of substance delivery device 100. Alternatively, division strip 162 is formed from a non-swelling material. When division strip 162 is non-swelling, the structural construction material 200 forms around division strip 162, thereby filling in any voids and forming a seal between adjacent substance delivery devices 100.

In an alternative embodiment without compartmentalization (not shown), the division strips may be eliminated and the substance delivery device 100 may include an extended first layer 130 for reinforcement at abutment between adjacent panels.

Referring to FIGS. 4 and 6, at least one tube 150 is engagedly attached to the first layer of the device 100 and extends outwardly therefrom. Tube 150 typically comprises an inlet 152, an outlet 154, and a cylinder 156 extending therebetween. The tube may be attached to the first layer in a variety of suitable ways, including for example, adhesive, mechanical interlock, ultrasonic weld, etc. One type of attachment may include a plurality of teeth (not shown) outwardly extending from outlet 154 that engage first layer 130. The tube 150 permits injection of an active substance into the air space between the first layer 130 and second layer 110 created by intermediate layer 120. The tube 150 extends through a construction form or framework, such as rebar matrix 210, and is of sufficient length that inlet 152 terminates exterior the structural construction material form (not shown). Tube 150 can be secured to rebar matrix 210 through ties, clamps, or other similar means of attachment. The number of tubes 150 necessary is dependent on the size of chamber 160. In the preferred embodiment of the invention, tubes 150 should be positioned at lower point 164, mid point 166, and upper point 168.

In a preferred embodiment depicted in FIG. 4, a structural construction material 200 is applied to the construction form or framework (not shown). The structural construction material 200 can be concrete (all forms, including shotcrete), plaster, stoneware, cinderblock, brick, wood, plastic, foam or other similar synthetic or natural materials known in the art. Second layer 110 of substance delivery device 100 provides the primary waterproof defense. If it is determined that second layer 110 has been punctured or has failed, resulting in water leaking to structural construction material 200, a free flowing active substance can be injected to the substance delivery device 100 located proximate the leak. The free flowing active substance is introduced to such panel of substance delivery device 100 via tubes 150 in an upward progression, wherein the free flowing substance is controllably introduced to lower point 164 of panel of substance delivery device 100, then to mid point 166 of panel of substance delivery device 100, and then to upper point 168 of panel of substance delivery device 100. A dye may be added to the free flowing substance, allowing for a visual determination of when to cease pumping the free flowing substance to the substance delivery device 100. When the dye in the free flowing substance leaks out of structural construction material 200, thereby indicating that the selected substance delivery device 100 is fully impregnated, pumping is ceased.

Permeable first layer 130 allows the free flowing active substance to permeate into the air space between second layer 110 and first layer 130, as well as any air space between the first layer 130 and the structural construction material 200. When the free flowing active substance is a hydrophilic liquid, the free flowing substance interacts with any water present, thereby causing the free flowing substance to expand and become impermeable, creating an impenetrable waterproof layer. Thus, a secondary waterproof barrier can be created if a failure occurs in second layer 110.

Alternatively, different free flowing active substances may be introduced to substance delivery device 100, depending on the situation. If the integrity of structural construction material 200 is compromised, a polymer resin or cementitious material for strengthening structural construction material 200 can be injected into substance delivery device 100 to repair structural construction material 200. Alternatively, a fluid (gas or liquid) containing an active substance, such as an insecticide, bactericide, mildewcide, mold inhibitor or rust inhibitor, may be injected into the substance delivery device 100 for providing mold protection, rust retardation, insect protection, or other similar purposes. Thus, the term active substance is intended to embrace any material other than water or air that provides a useful function or desirable attribute. Most preferably, the active substance will include a material such as a polymer resin or cementitious material that cures to a hardened state after injection into the device and provides a sealing or waterproofing effect.

In a separate and distinct embodiment of the invention, the multi-layer fluid delivery device may exclude intermediate layer 120, such as, for example where the second layer includes a plurality of protuberances extending toward the first layer or where the second layer has a wavy profile or other profile that creates an air space between the first layer and a substantial portion of the second layer. Alternatively, the intermediate layer 120 and the first layer 130 may comprise one integral piece. Such alternative embodiments will be described in more detail below. Several such alternative preferred embodiments are illustrated in FIGS. 7 to 16 (where tubes 150 have been omitted from the drawings for simplification purposes).

Figure 7:
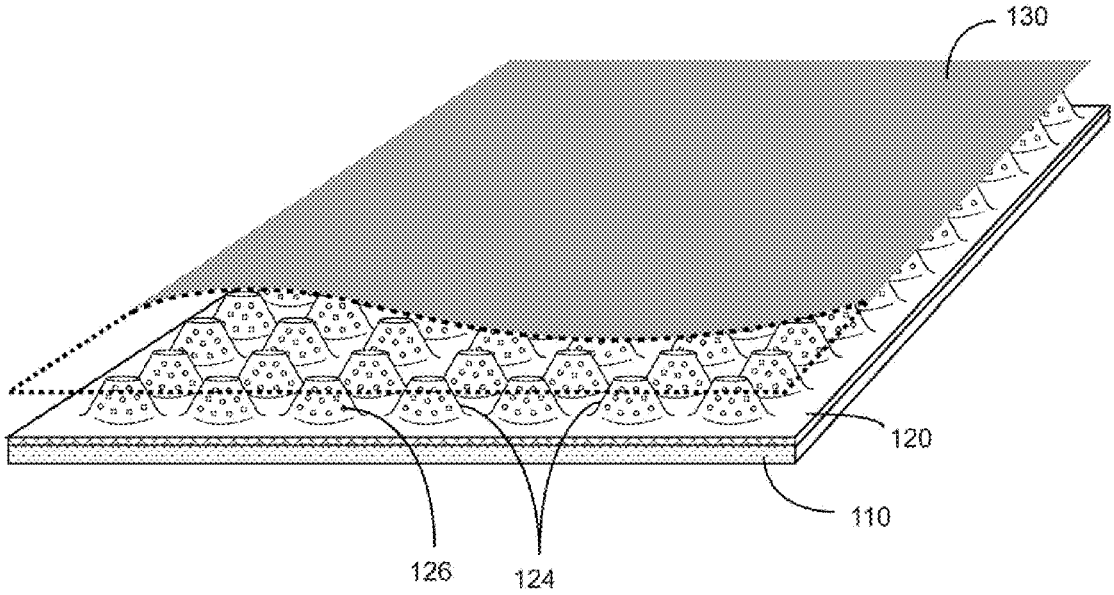
FIG. 7 is a perspective view of a second embodiment of a multi-layer fluid delivery device that includes an intermediate layer with perforated protuberances or dimples (tubes 150 not shown for simplification).
Figure 8:
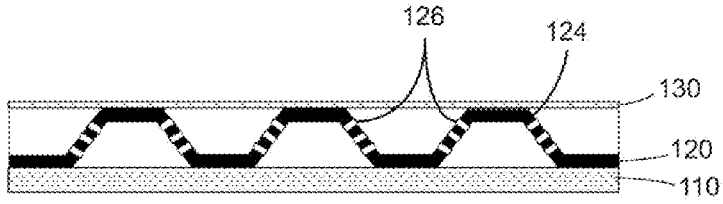
FIG. 8 is a top cross-sectional view of the device shown in FIG. 7

Referring to FIGS. 7 and 8, there is shown a second embodiment of the invention. In this embodiment, the first layer 130 and the second layer 110 are as previously described. The intermediate layer 120 includes a plurality of protuberances 124, which, in this case, are frustoconcially shaped dimples. Of course, the protuberances may be any desired shape, such as semi-spherical, pyramidal, conical, cylindrical, etc. A plurality of the protuberances abut the first layer 130 at the uppermost point of each protuberance, and may be adhered thereto, and thereby create an air space between the first layer and a substantial portion of the second layer. The protuberances preferably include a plurality of openings therethrough to provide an interconnected air space throughout the device and thereby permit passage of an active substance therethrough to partially or completely fill the air space between the first layer 130 and the second layer 110.

Figure 9:
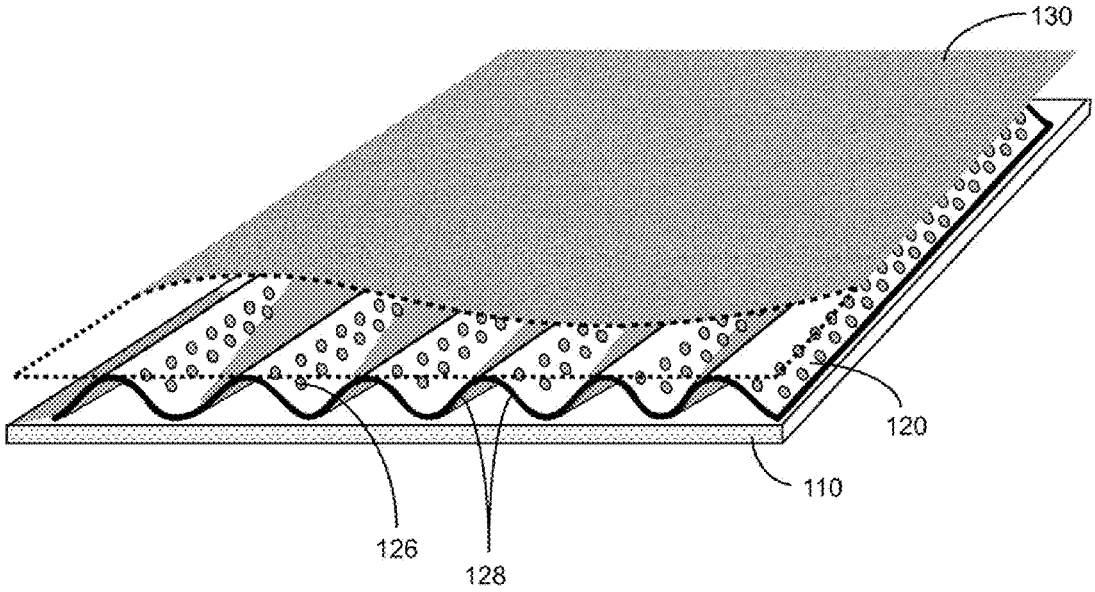
FIG. 9 is a perspective view of a third embodiment of a multi-layer fluid delivery device that includes an intermediate layer in the form of a perforated wavy sheet (tubes 150 not shown for simplification).
Figure 10:
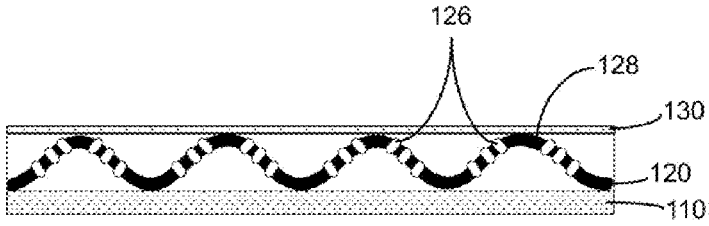
FIG. 10 is a top cross-sectional view of the device shown in FIG. 9.

Referring to FIGS. 9 and 10, there is shown a third embodiment of the invention. In this embodiment, the first layer 130 and the second layer 110 are as previously described. The intermediate layer 120 includes a plurality of protuberances 128, which, in this case, are in the shape of parallel, wave-shaped ribs that extend along a major axis of the intermediate layer. As can be seen in FIG. 10, essentially the intermediate layer 120 has a profile like a sinusoidal wave. A plurality of the protuberances abut the first layer 130 at the uppermost point of each protuberance, and may be adhered thereto, and thereby create an air space between the first layer and a substantial portion of the second layer. The protuberances preferably include a plurality of openings therethrough to provide an interconnected air space throughout the device and thereby permit passage of an active substance therethrough to partially or completely fill the air space between the first layer 130 and the second layer 110.

Figure 11:
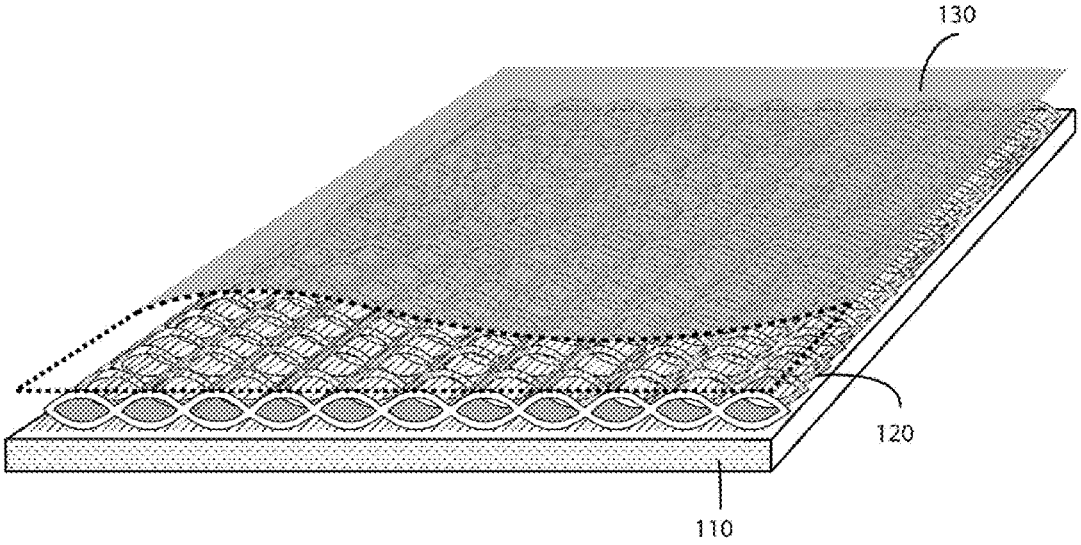
FIG. 11 is a perspective view of a fourth embodiment of a multi-layer fluid delivery device that includes a geotextile matrix with a tubular internal profile (tubes 150 not shown for simplification).
Figure 12:
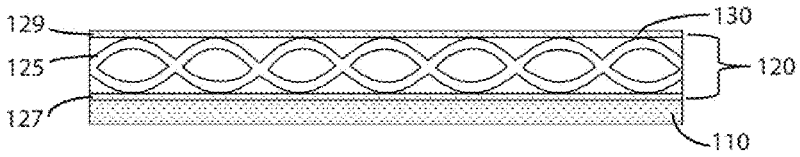
FIG. 12 is a top cross-sectional view of the device shown in FIG. 11.

Referring to FIGS. 11 and 12, there is shown a fourth embodiment of the invention. In this embodiment, the second layer 110 is as previously described. However, the first layer 130 and intermediate layer 120 are combined into an integral unit. Referring to FIG. 12, the intermediate layer 120 includes a pair of planar geotextile matrices 127, 129 that are separated by parallel, tubular shaped geotextile matrices 125 that extend along a major axis of the intermediate layer. The geotextile matrices may be woven or non-woven, and preferably comprise a polyolefin fiber. The planar geotextile matrix 129, in addition to binding together the tubular shaped matrix 125, also serves as the permeable first layer 130. The tubular shaped geotextile matrix 125 adds strength and rigidity to the intermediate layer while creating a substantial interconnected air space, thereby permitting passage of an active substance therethrough to partially or completely fill the air space between the first layer 130 and the second layer 110.

Figure 13:
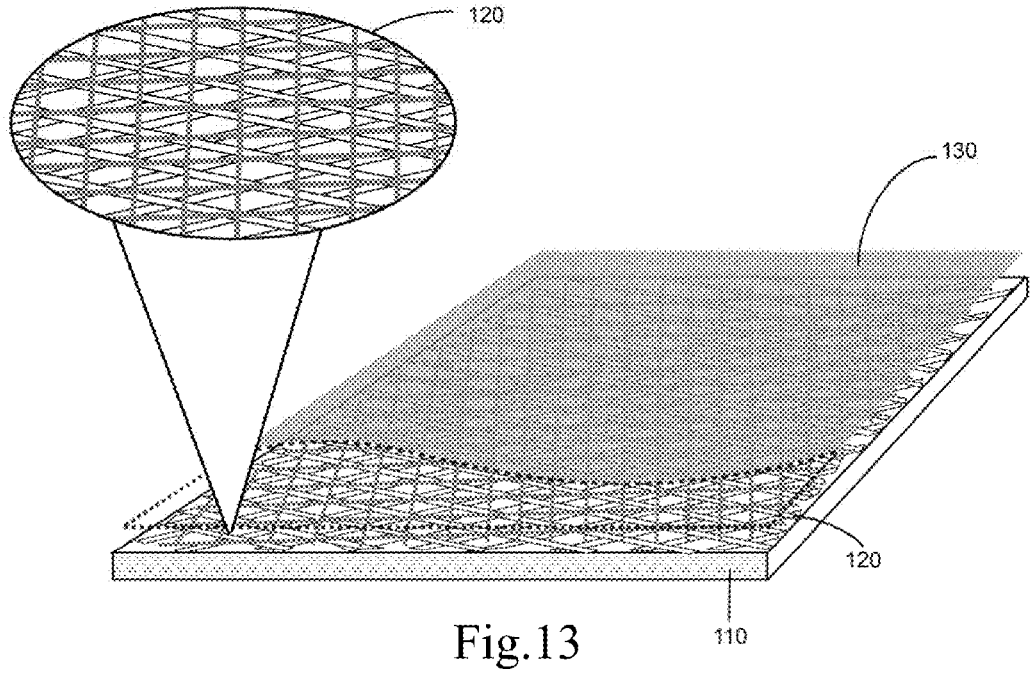
FIG. 13 is a perspective view of a fifth embodiment of a multi-layer fluid delivery device that includes an intermediate layer with offset grid multi-layers (tubes 150 not shown for simplification).

Referring to FIG. 13, there is shown a fifth embodiment of the invention. In this embodiment, the first layer 130 and the second layer 110 are as previously described. The intermediate layer 120 comprises plural layers of offset polymeric grids. The grids may be a layer of parallel spokes of polymer strands overlaid at an angle upon a similar layer of parallel spokes of polymer strands, or a layer of rectangular or diamond shaped polymer grids overlaid, at an angle, over a similar layer of rectangular or diamond shaped polymer grids. These grids create an interconnected air space between the first layer 130 and the second layer 110, thereby permitting passage of an active substance therethrough to partially or completely fill the air space between the first layer 130 and the second layer 110.

Figure 14:
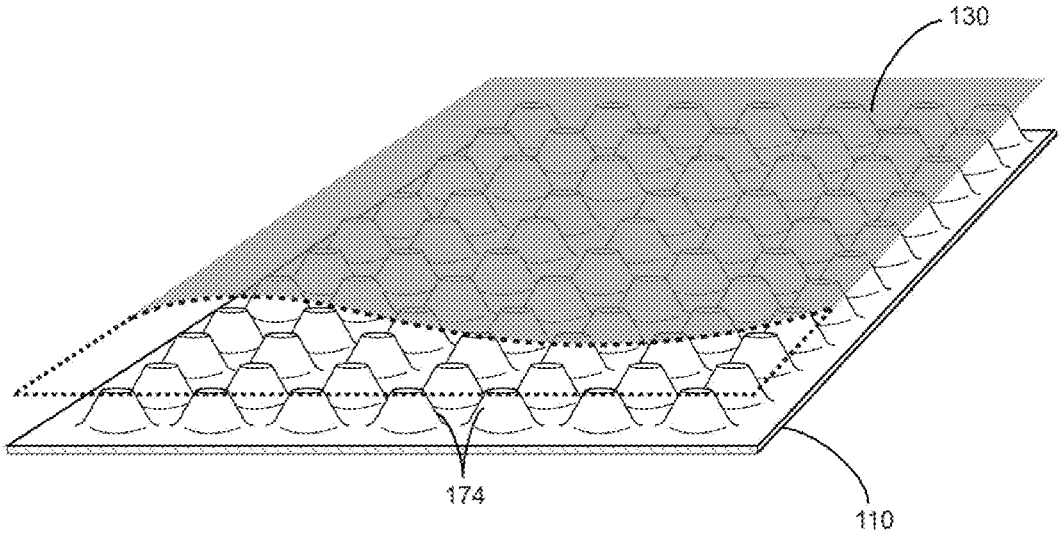
FIG. 14 is a perspective view of a sixth embodiment of a multi-layer fluid delivery device that includes a dimpled sheet as the second layer of the device and no intermediate layer.
Figure 15:
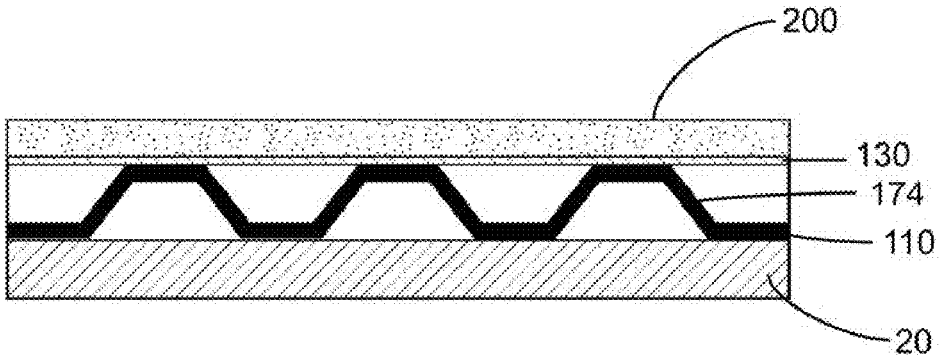
FIG. 15 is a cross sectional top view of the embodiment shown in FIG. 14 installed between concrete and a structural substrate.
Figure 16:
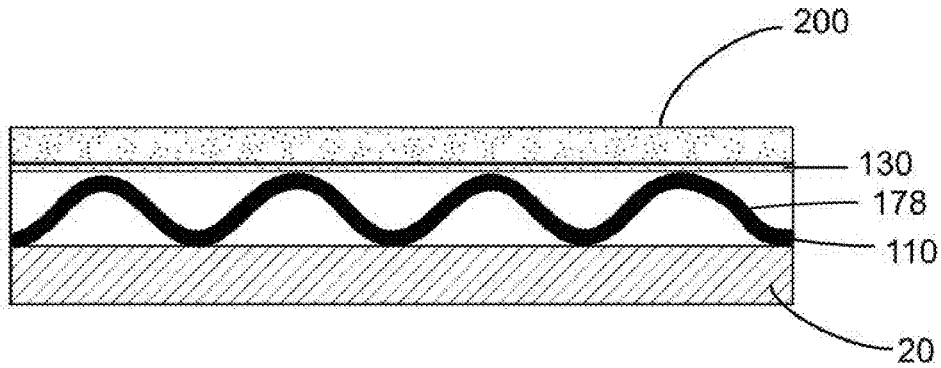
FIG. 16 is a cross-sectional top view of a further embodiment similar to that shown in FIG. 15 that includes a wavy sheet as the second layer of the device.

Referring to FIGS. 14 and 15, there is shown a sixth embodiment of the present invention. In this embodiment, there is no intermediate layer. The first layer 130 is as previously described. The second layer 110 is a water impermeable solid polymeric sheet that includes a plurality of protuberances 174, which, in this case, are frustoconcially shaped dimples. Of course, the protuberances may be any desired shape, such as semi-spherical, pyramidal, conical, cylindrical, etc. A plurality of the protuberances abut the first layer 130 at the uppermost point of each protuberance 174, and may be adhered thereto, and thereby create an air space between the first layer and a substantial portion of the second layer. This air space may be subsequently filled with an active substance such as a polymer resin or cementitious material. In FIG. 15, the device is shown attached to a structural substrate 20 (e.g., a shoring system) with a structural construction material 200 (e.g., concrete) applied against it. Alternatively, instead of dimple-shape protuberances as described above, the second layer 130 may have a wavy profile so as to provide a plurality of parallel, wave-shaped ribs 178 that extend along a major axis of the second layer, for example, as depicted in cross-section in FIG. 16.

In a separate and distinct embodiment of the invention, substance delivery device 100 is directly attached to the earth, such as in a tunnel or mine. In this embodiment, substance delivery device 100 may be installed as previously described, or alternatively it may be inversely installed, such that the first layer 130 faces the tunnel surface and the second layer 110 inwardly faces the tunnel space. Substance delivery device 100 can be fixedly attached by applying an adhesive to first layer 130, driving nails through substance delivery device 100, or similar attaching means known in the art. Substance delivery device 100 is installed in vertical segments, similar to the method described above for the preferred embodiment. However, the plurality of tubes 150 is not necessary in the alternative embodiment.

In this alternative application, once substance delivery device 100 is installed against the tunnel surface, the structural construction material 200 can be installed directly onto second layer 110. Should a failure occur in substance delivery device 100, an operator can drill a plurality of holes through the structural construction material 200, ceasing when second layer 110 is penetrated. Such holes would provide fluid access to intermediate layer 120. An active fluid substance (not shown) would then be pumped through the holes, thereby introducing the fluid substance to intermediate member 120, which would then channel the fluid substance throughout substance delivery device 100, ultimately permitting first layer 130 to permeate the fluid substance therethrough.

The foregoing description of the invention illustrates several preferred embodiments thereof. Various changes and modifications may be made in the details of the illustrated construction within the scope of the appended claims without departing from the true spirit of the invention. For example, various commercially available construction drainage products may be utilized as one or more layers of the device of the present invention. Such products include those sold under the following product brands, for example, Colbond Enkadrain®, Pozidrain®, Terradrain®, Senergy®, Tenax®, Blanke Ultra-Drain®, AmerDrain®, Superseal SuperDrain®, J-Drain®, Viscoret® dimpled membrane, Terram® drainage composites, and Delta®-MS drainage membranes.

The present invention should only be limited by the claims and their equivalents. Should the disclosure in prior application U.S. Ser. No. 11/066,927, or any foreign counterpart thereto, be deemed to adversely impact the novelty of any claim presented in this application, then the present disclosure disclaims (for claim amendment purposes only) any and/or all specific embodiments disclosed in the aforementioned prior application, but only to the extent necessary to support amended claims that include a disclaimer of subject matter disclosed in the prior application.

What is claimed is:

1. A fluid delivery system for introducing a free-flowing active substance to a structure in situ, said system comprising:

an integral, multi-layer device comprising a first layer and a second layer, said first layer having an inwardly facing surface and an outwardly facing surface, said first layer being a material that is permeable to said active substance but at least nearly impermeable to a structural construction material to be applied against said outwardly facing surface of said first layer;

said second layer being water impermeable and having an inwardly facing first side and an outwardly facing second side, said inwardly facing first side of said second layer being affixed directly or indirectly to said inwardly facing surface of said first layer such that all or a substantial portion of said second layer is spaced apart from said first layer to create air space between said first and second layers, wherein said second layer has a plurality of protuberances extending toward and contacting said first layer, wherein each of said protuberances includes a plurality of openings to permit passage of said active substance therethrough; and a plurality of tubes adapted to be affixed to said device in communication with said air space to permit inflow of said active substance into said air space.

2. The system according to claim 1 wherein said protuberances are frustoconically shaped.

3. The system according to claim 1 wherein said protuberances comprise parallel wave-shaped ribs that extend along a major axis of said second layer.

4. The system according to claim 1 further comprising an adhesive on said second side of said second layer.

5. A fluid delivery system for introducing a free-flowing active substance to a structure in situ, said system comprising:

an integral, multi-layer device comprising a first layer, a second layer and an intermediate layer;

said first layer having an inwardly facing surface and an outwardly facing surface, said first layer being a material that is permeable to said active substance but at least nearly impermeable to a structural construction material to be applied against said outwardly facing surface of said first layer;

said second layer being water impermeable and having an inwardly facing first side and an outwardly facing second side, said inwardly facing first side of said second layer being affixed directly or indirectly to said inwardly facing surface of said first layer such that all or a substantial portion of said second layer is spaced apart from said first layer to create air space between said first and second layers;

said intermediate layer located between said first layer and said second layer, wherein said intermediate layer comprises a sheet with a plurality of protuberances that extend toward said first layer, each of said protuberances including a plurality of openings to permit passage of said active substance therethrough, thereby providing a plurality of interconnected interstitial air spaces sufficient to permit inflow of said active substance between said first layer and said second layer; and a plurality of tubes adapted to be affixed to said device in communication with said air space to permit inflow of said active substance into said air space.

6. The system according to claim 5 further comprising an adhesive on said second side of said second layer.

7. A fluid delivery system for introducing a free-flowing active substance to a structure in situ, said system comprising:

an integral, multi-layer device comprising a first layer, a second layer and an intermediate layer;

said first layer having an inwardly facing surface and an outwardly facing surface, said first layer being a material that is permeable to said active substance but at least nearly impermeable to a structural construction material to be applied against said outwardly facing surface of said first layer;

said second layer being water impermeable and substantially planar and having an inwardly facing first side and an outwardly facing second side, said inwardly facing first side of said second layer being affixed directly or indirectly to said inwardly facing surface of said first layer such that all or a substantial portion of said second layer is spaced apart from said first layer to create air space between said first layer and said second layer;

said intermediate layer located between said first layer and said second layer, wherein said intermediate layer includes a plurality of interconnected interstitial air spaces sufficient to permit inflow of said active substance between said first layer and said second layer; wherein said intermediate layer comprises a member selected from the group consisting of: (a) a sheet with a plurality of frustoconically shaped protuberances that extend toward said first layer and wherein each of said protuberances includes a plurality of openings; (b) a sheet with a plurality of protuberances that extend toward said first layer wherein said protuberances comprise parallel wave-shaped ribs that extend along a major axis of said intermediate layer and wherein each of said protuberances includes a plurality of openings; (c) a pair of planar geotextile matrices separated by parallel tubular-shaped geotextile matrices that extend along a major axis of said intermediate layer; (d) plural layers of offset polymeric grids; and (e) an open lattice of fibers or fused filaments; and a plurality of tubes adapted to be affixed to said device in communication with said air space to permit inflow of said active substance into said air space.

8. The system according to claim 7 wherein said active substance comprises a flowable cementitious or polymer resin material that will solidify upon curing.

9. The system according to claim 7 wherein said second layer includes an extension portion adapted to provide an underlay for overlapping a subsequently installed multi-layer device thereupon.

10. The system according to claim 7 wherein said intermediate layer comprises a sheet with a plurality of frustoconically shaped protuberances that extend toward said first layer and wherein each of said protuberances includes a plurality of openings.

11. The system according to claim 7 wherein said intermediate layer comprises a sheet with a plurality of protuberances that extend toward said first layer wherein said protuberances comprise parallel wave-shaped ribs that extend along a major axis of said intermediate layer and wherein each of said protuberances includes a plurality of openings.

12. The system according to claim 7 wherein said intermediate layer comprises a pair of planar geotextile matrices separated by parallel tubular-shaped geotextile matrices that extend along a major axis of said intermediate layer.

13. The system according to claim 12 wherein said first layer is integral with said intermediate layer and comprises one of said planar geotextile matrices of said intermediate layer.

14. The system according to claim 7 wherein said intermediate layer comprises plural layers of offset polymeric grids.

15. The system according to claim 7 wherein said intermediate layer comprises an open lattice of fibers or fused filaments.

16. The system according to claim 7 further comprising an adhesive on said second side of said second layer.

* * * * *